United States Patent [19]

Conti

[11] Patent Number: 4,765,080

[45] Date of Patent: Aug. 23, 1988

[54] ILLUMINATED INFORMATION DISPLAY APPARATUS

[76] Inventor: William L. Conti, P.O. Box 3821, Pensacola, Fla. 32506

[21] Appl. No.: 781,639

[22] Filed: Sep. 30, 1985

[51] Int. Cl.[4] ..... G09F 13/04

[52] U.S. Cl. ..... 40/576; 40/465

[58] Field of Search ..... 40/576, 465, 549, 575, 40/574, 564

[56] References Cited

U.S. PATENT DOCUMENTS

| | | | |
|---|---|---|---|
| 733,800 | 7/1903 | Beugler | 40/576 |
| 871,510 | 11/1907 | Kerr | 40/575 |
| 1,447,918 | 3/1923 | Zacher | 40/576 |
| 1,448,881 | 3/1923 | Theis | 40/576 |
| 1,836,669 | 12/1931 | Koch | 40/575 |
| 2,245,885 | 6/1941 | Webster | 40/575 |
| 3,742,633 | 7/1973 | Palm | 40/576 |
| 3,748,018 | 7/1973 | Borden, Jr. | 40/562 |
| 3,864,861 | 2/1975 | Hill, Jr. | 40/576 |
| 4,254,457 | 3/1981 | Lordier | 40/576 |
| 4,387,522 | 6/1983 | Sommers-Szoszky | 40/576 |
| 4,553,345 | 11/1985 | Bercier et al. | 40/576 |
| 4,587,753 | 5/1986 | Harper | 40/580 |

FOREIGN PATENT DOCUMENTS

| | | | |
|---|---|---|---|
| 908285 | 4/1946 | France | 40/575 |
| 1477169 | 4/1967 | France | 40/564 |
| 6408482 | 1/1966 | Netherlands | 40/564 |
| 1242523 | 8/1971 | United Kingdom | 40/576 |

*Primary Examiner*—Robert P. Swiatek
*Assistant Examiner*—Cary E. Stone
*Attorney, Agent, or Firm*—Fleit, Jacobson, Cohn & Price

[57] ABSTRACT

An illuminated information display apparatus comprising: a rectangular frame member having top, bottom and side walls defining an elongated housing having at least one open face; grooves provided in opposing marginal edges of the top and bottom walls of the housing and extending the length thereof; a plurality of interlocking indicia bearing plate members sized to be slidably received in the opposed grooves, the plate members having light transmitting and blocking portions thereon; a source of illumination mounted interiorly of the housing; and a photoelectric cell connected to the source of illumination and exposed to ambient light conditions for selectively activating and deactivating the source of illumination at predetermined states of ambient light.

18 Claims, 1 Drawing Sheet

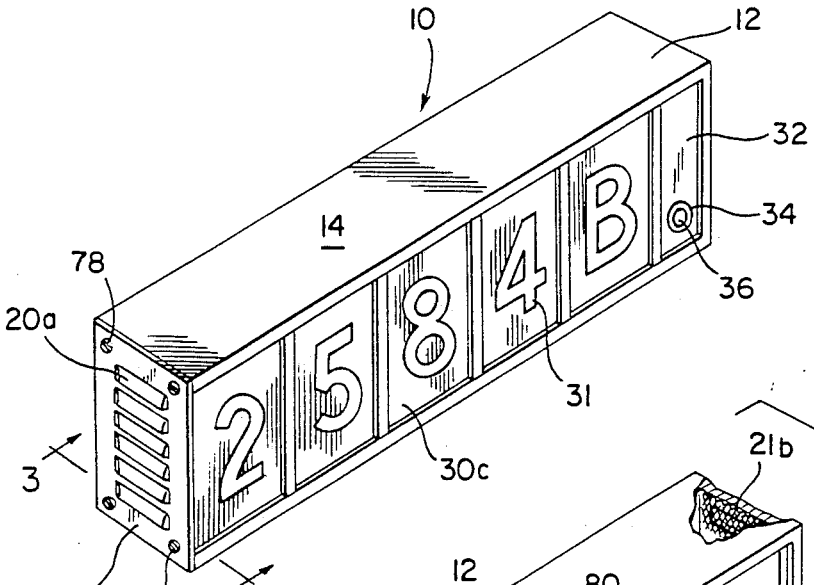
FIG. 1
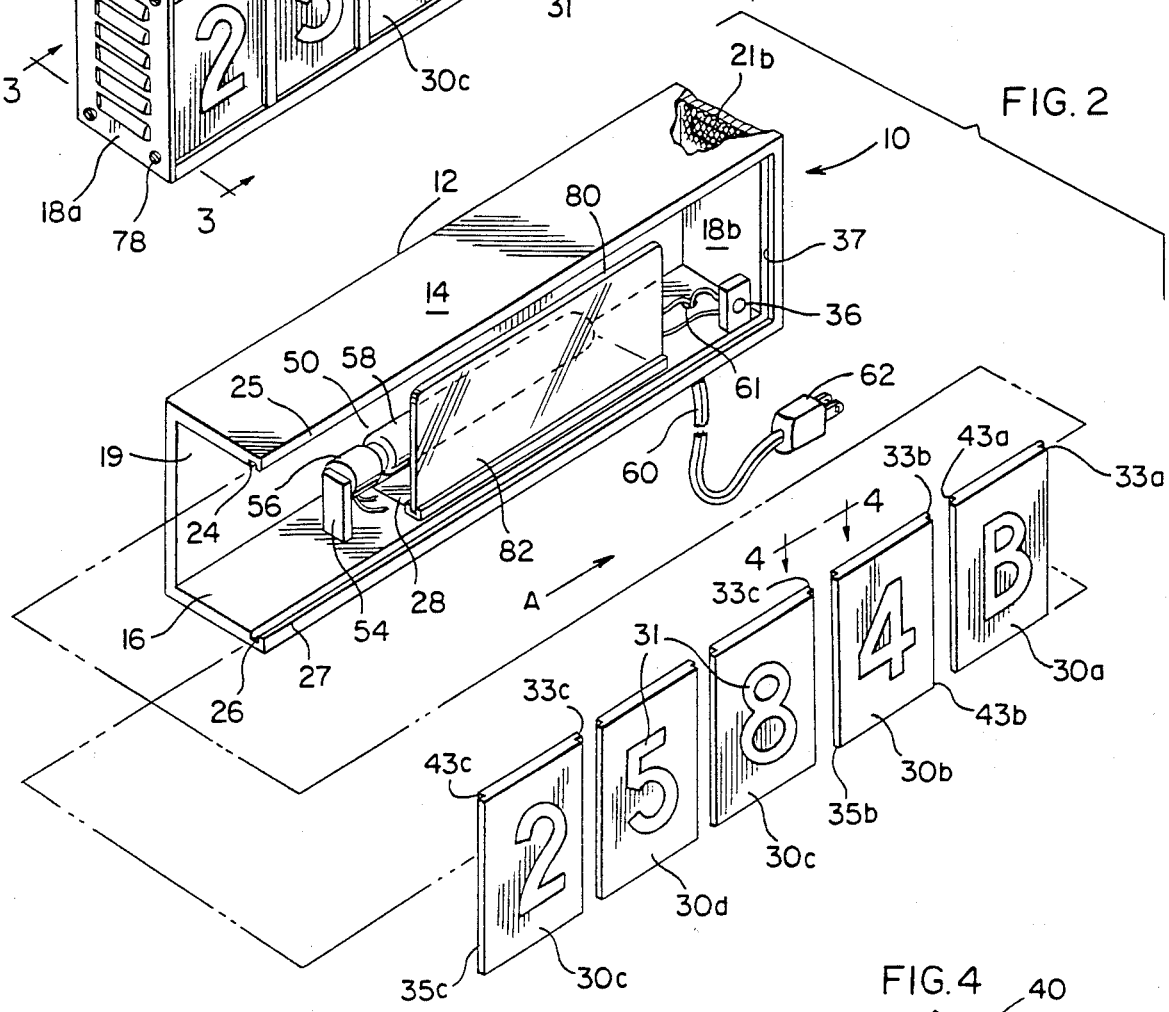
FIG. 2
FIG. 4
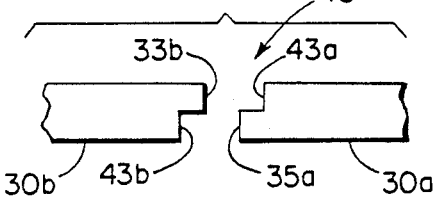
FIG. 5
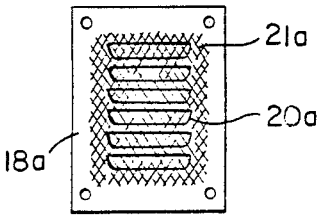
FIG. 3
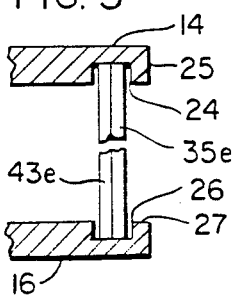
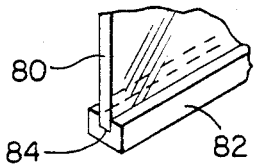
FIG. 6

ILLUMINATED INFORMATION DISPLAY APPARATUS

BACKGROUND OF THE INVENTION

1. Field of the Invention

The present invention relates to illuminated information displaying apparatus and more particularly to illuminated signs having changeable panels bearing numbers and letters with the source of illumination automatically activated and deactivated by a photoelectric cell preset to turn on the illumination source upon reaching normal dusk conditions and preset to turn such source off upon reaching normal sunrise conditions.

2. General Background

Different patents directed to illuminated signs for displaying changeable numbers and letters are known in the art.

In some illuminated signs such as neon signs, the light source is carried in and made a part of the letters, numbers or other characters forming the message. The letters, numbers and other characters are generally exposed and not readily changeable.

The second type of illuminated sign is comprised of a translucent front face having letters or numbers or other characters painted thereon with opaque paint and has a light source behind the face so that the entire face of the sign, with the exception of the opaque portion, is illuminated, thus providing a visible message during the day and night. The message on this type of sign is not easily changeable.

The third type of illuminated sign is comprised of a translucent face having a light source therebehind and generally having some type of track means on the exterior of the face such that the numbers, letters and other indicia characters can be retained in a desired sequence in front of the translucent face so as to spell out the message and be visible at night. The letters, numerals and other indicia are changeable in this type of sign. A prior art search of this type of illuminated sign that provides means for a changeable display message reveals that different patents directed to such structure have been issued.

U.S Pat. No. 4,373,284 entitled "Illuminated House Number Sign" issued to D. L. Crane and discloses an illuminated sign having a frame enclosed by a transparent cover. Grooved tracks are utilized to receive and retain display plates which have light transmitting portions therein in the shape of letters or numbers. A central light source provides illumination and the translucent sheet diffuses the light so that a uniformly bright message appears when the light source is energized and selected plates are abutted end to end in the tracks.

U.S. Pat. No. 3,414,999 entitled "Illuminated Sign" issued to L. Mason and discloses an illuminated sign having removable indicia illuminated from within.

U.S. Pat. No. 2,893,148 entitled "Illuminating Fluorescent House Number Fixture" issued to M. Figman and discloses a fluorescent house number fixture having removable indicia members mounted along the length of a fluorescent tube.

U.S. Pat. No. 1,831,181 entitled "House Numbering Device" issued to C. M. Koster and discloses an illuminated sign having removable and interchangeable numbers.

U.S. Pat. No. 1,081,646 issued to R. K. Witz and discloses an illuminated display sign having removable transparent plates bearing letters or other characters.

U.S. Pat. No. 1,208,870 entitled "Combined Light and Illuminated Sign" issued to E. H. Whitlock and discloses an illuminated sign.

U.S. Pat. No. 1,448,881 entitled, "Combination Number Reflector And Hall Light" issued to J. P. Theis and discloses an illuminated sign for displaying numbers or letters having a housing with a set of grooves therein for inserting panels bearing numbers or letters therein for illumination by an electric light.

The Applicant has provided an improved illuminated display apparatus in which the panels displaying the information interlock with each other, and, in which the illumination source is automatically activated and deactivated by a photoelectric cell preset to turn the source of light on upon reaching normal dusk conditions and turn such source off upon reaching normal sunrise conditions.

SUMMARY OF THE INVENTION

The present invention provides for an illuminated information display apparatus comprising a rectangular elongated housing having top, bottom and side walls and at least one open face, the apparatus having grooves provided in opposing marginal edges of the top and bottom walls and extending the length thereof for slidably receiving a plurality of interlocking plate members forming a continuous rigid wall assembly having opaque and light transmitting portions, a light source mounted within the housing and a photoelectric cell exposed to ambient light conditions through a transparent end plate of the wall assembly for selectively activating and deactivating the light source upon reaching predetermined states of ambient light. The opaque and light transmitting portions of the plates positioned in the grooves out a message such as name or street address or the like. The photoelectric cell is designed to turn on to illuminate the display apparatus at normal dusk (and other dark ambient conditions) and turn off at normal sunrise (and other bright ambient conditions).

BRIEF DESCRIPTION OF THE DRAWINGS

For a further understanding of the nature and objects of the present invention, reference should he had to the following detailed description, taken in conjunction with the accompanying drawings, in which like parts are given like reference numerals and, wherein:

FIG. 1 is a perspective view of the preferred embodiment of the apparatus of the present invention;

FIG. 2 is an exploded view of the apparatus of FIG. 1 showing details of construction;

FIG. 3 is an enlarged partial sectional view taken along line 3—3 of FIG. 1;

FIG. 4 is an enlarged partial top view of the interlocking side edges of the indicia bearing plate members of the present invention taken along Line 4-4 of FIG. 2;

FIG. 5 is a rear view of one of the side walls of the apparatus of the present invention; and FIG. 6 is a partial enlarged perspective view of the deflector means of the apparatus of the present invention.

DETAILED DESCRIPTION OF THE PREFERRED EMBODIMENT

FIGS. 1 and 2 best illustrate the preferred embodiment of the apparatus of the present invention designated generally by the numeral 10. Apparatus 10 comprises an elongated rectangular frame or housing 12 having a top wall 14, bottom wall 16 and side walls 18*a*, 18*b*. Thus housing 12 has at least one (1) open face. In the preferred embodiment of FIGS. 1 and 2, apparatus 10 is provided with a forward open face and enclosed rearward portion defined by wall 19, although in an alternate embodiment (not shown) wall 19 can be removed so that two (2) open faces can be provided to apparatus 10. Also in the preferred embodiment, one side wall (18*a* in FIGS. 1 and 5) is provided with a plurality of horizontally disposed louvred 20 vents (louvred vent 20*a* of side wall 18*a*), the louvres depending exteriorally of housing 12, and a bug screen 21 (screen 21*a* of side wall 18*a*) of medium to fine mesh provided on the inside surface of the side wall 21 so as to cover all of the louvred vents 20 as best illustrated in FIG. 5 having bug screen 21*a* on the interior surface of side wall 18*a* so as to cover louvred vents 20*a* exteriorally depending from side wall 18*a*. Side wall 18*a* is removably affixed to housing 12 at the edges of top and bottom walls 14, 16 in a conventional manner such as by threaded screws 78 or the like. FIG. 2 in cut-away view illustrates a bug screen 21*b* provided on the interior surface of side wall 18*b* should both side walls 18*a*, 18*b* be provided with louvred vents 20*a*, 20*b*.

As best seen in FIGS. 2 and 3, top wall 14 and bottom wall 16 have provided in interiorly opposing marginal edges thereof grooves or tracks 24, 26 respectively which extend the length thereof thus defining overhanging lip portions 25, 27 in top and bottom walls 14, 16 respectively.

Grooves 24, 26 afford guidance and support means for a plurality of plate or panel members 30 (30*a*–30*e* for example), preferably of plexiglass construction. In the preferred embodiment, plexiglass plate members 30 being transparent have white translucent indicia such as numbers 31, figures or designs and an opaque background thereon. Plate members 30 being rigid because of the plexiglass construction are sized to be slidably received in opposing grooves 24, 26 in top and bottom walls 14, 16 respectively.

As best seen in FIGS. 2, 3 and 4, means 40 are provided on each plate member 30 for interlocking adjacent plate members 30. Interlocking laterally depending means 40 is best seen in FIG. 4 and comprises laterally depending overhanging lip portion 35 on the trailing edge of one plate member 30 mating with laterally depending overhanging lip portion 33 (the inverted mirror image of lip portion 35) on the leading edge of the adjacent plate member 30. Thus as seen in FIG. 4, any two individual plate members such as 30*a*, 30*b* are slidably received in grooves 24, 26 and moved longitudinally thereof in the direction of ARROW A, and as these adjacent plate members 30*a*, 30*b* approach each other the trailing edge of the lead plate member 30*a* having overhanging lip portion 35*a* and it corresponding indented surface 43*a* snugly engages the indented surface 43*b* and overhanging lip portion 33*b* of the leading edge of the trailing plate member 30*b*. Thus plate member 30*b* is snugly mated with plate member 30*a* interconnecting the leading and trailing plate members 30*a*, 30*b*. Thus it can be readily understood that any number of consecutive plate members 30 (30*a*–30*e*) can be serially interlocked to form a continuous wall assembly as shown in FIG. 1 by means 40 comprised of corresponding overlapping edge formations including lip portions 33, 35 (33*a*–*e* and 35*a*–*e*) mating with corresponding indented surfaces 43 (43*a*–*e*).

Returning now to FIG. 2, distal side wall 18*b* of housing 12 is provided with a groove 37 interiorly thereof so as to mate with grooves 24, 26 of top and bottom walls 14, 16 respectively so that the leading plate member 30*a* can have its leading edge 33*a* snugly accepted therein. Plate members 30 can be selectively removed from or inserted into grooves 24, 26 of apparatus 10 (after the removal of side wall 18*a*) by movement in the direction opposite ARROW A. The assembly of plate members 30 and 32 are accordingly retained in place by the side wall 18*a* as shown in FIG. 1.

Apparatus 10 is further provided with a source of illumination 50 mounted therein. As best seen in FIGURE 2, source of illumination 50 is mounted interiorly of housing 12 and to bottom wall 16 by mounting bracket 54. Provided on mounting bracket 54 and spaced a vertical distance from bottom wall 16 is a conventional electrical socket 56 adapted to accept a conventional bulb 58 such as a 130-Volt, 40 Watt incadescent bulb which is connected via socket 56 to wire 60 which passes through aperture 61 in wall 16 and has at its distal end exterior of housing 12 a conventional electrical plug 62 which can be inserted in a conventional 110-Volt electrical outlet to provide a source of electrical energy to activate light 58. To prevent bright spots on plate member 30 with light 58 activated, a transparent deflector means or plate 80, best seen in FIGS. 2 and 6, is provided in housing 12 intermediate light 58 and plate members 30. Deflector 80 is vertically slidably inserted into and mounted in channel 84 of support 82 which is fixedly mounted to bottom wall 16 of housing 12 as best seen in FIG. 2. To prevent overheating within the chamber formed by housing 12 when the front and rear faces are closed by plate members 30 and a rear wall 19 and bulb 58 is activated, louvred air vents 20*a* are provided in side walls 18*a* (louvred vents 20*b* can be provided in side wall 18*b*). A bug screen 21 is also provided as discussed above. Further apparatus 10 is provided in its bottom wall 16 with an elongated glass pane 28 so that light can be emitted from the bottom of apparatus 10 for purposes to be described further herein.

As best seen in FIGS. 1 and 2, apparatus 10 is further provided with a means 36 for selectively activating and deactivating light source 58 at predetermined states of ambient light. In the preferred embodiment means 36 is a photoelectric cell which is mounted in aperture 34 provided in end plate member 32 (similar to plate members 30 except for width) so that photoelectric cell 36 is continuously exposed to ambient light conditions. Photoelectric cell 36 would be connected in the conventional electrical manner to light source 58 via socket 56. Photoelectric cell 36 would be preset to activate light source 58 when the ambient light reaches a certain minimum brightness (as at dusk) and to deactivate light source 58 when the ambient light condition reaches a certain maximum brightness (as at sunrise). In this way apparatus 10 is automatically illuminated by photoelectric cell 36 at dusk and the illumination terminates at sunrise when photoelectric cell 36 deactivates light source 58 and indicia displayed on plate members 30 can be read without the assistance of illumination.

As aforementioned apparatus 10 has provided in bottom wall 16 an elongated glass pane 28 which, when photoelectric cell 36 activates light source 58, will pass light below apparatus 10 to provide an additional source of illumination. With apparatus 10 installed on the front porch of a home and light source 58 activated, not only would the indicia on plates 30 be visible to a viewer but an additional source of light provided through pane 28 would provide the viewer an additional margin of safety for climbing up the porch and the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense. The invention is to be limited only by the scope of the claims appended hereto.

What is claimed this invention is:

1. An illuminated information display apparatus comprising:

a. a rectangular frame member having top, bottom and side walls defining an elongated housing having at least one open face;

b. grooves provided in interiorly opposing marginal edges of said top and bottom walls and extending the length thereof;

c. a plurality of plate members sized to be slidably received in said opposed grooves to form therewith a continuous rigid wall assembly, some of said plate members having light transmitting and light blocking portions thereon forming indicia;

d. a source of illumination mounted interiorly of said housing;

e. means connected to said source of illumination and exposed to ambient light conditions at one of the plate members for selectively activating and deactivating said source of illumination at predetermined states of ambient light; and f. means spaced from the wall assembly internally of the housing for preventing the direct exposure of light emitted from said source of illumination from impinging on said plate members, said means for selectively activating and deactivating said source of illumination being mounted on said one of the plate members exteriorly of the housing.

2. The apparatus of claim 1 further comprising a groove provided in the interior marginal edge of one of said side walls and extending the length thereof to receive said one of the plate members and mating grooves provided in opposing marginal edges of said top and bottom walls.

3. The apparatus of claim 1 wherein said means for selectively activating and deactivating said source of illumination is a photoelectric cell.

4. The apparatus of claim 1 wherein said predetermined state of ambient light for activating said source of illumination corresponds to normal conditions at dusk.

5. The apparatus of claim 1 wherein said predetermined state of ambient light for deactivating said source of illumination corresponds to normal conditions at sunrise.

6. The apparatus of claim 1 wherein one of said side walls is removably mounted to said top and bototm walls.

7. The apparatus of claim 1, wherein one of said side walls is provided with a plurality of louvred vents.

8. The apparatus of claim 1 wherein said plate members are provided with means for interlocking.

9. The apparatus of claim 1 wherein said preventing means is provided intermediate said source of illumination and said plate members.

10. The apparatus of claim 9 wherein said preventing means is a second plate member vertically and slidably mounted in a channel provided intermediate said source of illumination and said plate members.

11. The apparatus of claim 10 wherein said second plate member is made of a light deflecting material.

12. An illuminated information display comprising a rectangular housing having an elongated top wall, an enlongated bottom wall and side walls at opposite ends of the top and bottom walls to form at least one open face, a track formation extending interiorly within said housing adjacent the open face and having a pair of opposed grooves prependicular to the top and the bottom walls and open interiorly of the housing, a plurality of plate members sized to be received in said opposed grooves, said plate members having opaque and light transmitting portions, a light source within the housing, light deflecting means within the housing for diffusing light from the source and illuminating the light transmitting portions to display messages on the plate members changed by insertion and removal of the plate members from abutting positions within the opposed grooves, the improvement comprising means interlocking the plate members in said abutting positions within said opposed grooves for forming a continuous rigid wall assembly closing said open face of the housing, means operatively connecting the side walls to the top and bottom walls for removal of one of the side walls to permit said insertion and removal of the plate members between the pair of opposed grooves respectively formed in the top and bottom walls and light responsive means mounted in one of the plate members abutting one of said walls for activating and deactivating said light source.

13. The display as defined in claim 12 wherein said one of the plate members is received in a groove formed in one of the side walls.

14. The display as defined in claim 13 including means mounting the light deflecting means in spaced relation to the continuous wall assembly.

15. The display as defined in claim 14 wherein said plate members are transparent plexiglass panels.

16. The display as defined in claim 15 wherein said interlocking means includes overlapping abutting edge formations on the panels.

17. The improvement as defined in claim 12 wherein said interlocking means includes overlapping abutting edge formations on the plate members.

18. An illuminated information display comprising a housing having at least one open face, a continuous rigid wall assembly closing said open face and having opaque and light transmitting portions thereon forming indicia, a source of illumination mounted within the housing, track means formed in the housing receiving the wall assembly therein for retention in closing relation to the open face of the housing, said wall assembly comprising a plurality of panels and means for interlocking the panels in abutting relation to each other within the track means, removable wall means mounted on the housing and providing access to the track means for selectively changing the panels of the wall assembly, one of the panels being in abutment with the removable wall means and means responsive to ambient light mounted in said one of the panels for controlling the source of the light.

* * * * *